United States Patent [19]

Becker et al.

[11] 4,220,326

[45] Sep. 2, 1980

[54] ADJUSTABLE SUPPORT APPARATUS FOR SEGMENTS OF AN AMUSEMENT SLIDE

[76] Inventors: Klaus Becker, Haydnstr. 5,, D-5802 Wetter; Dieter Behrmann, Grimmestr, 23, D-5800 Hagen, both of Fed. Rep. of Germany

[21] Appl. No.: 9,649

[22] Filed: Feb. 5, 1979

[30] Foreign Application Priority Data

Aug. 10, 1978 [DE] Fed. Rep. of Germany ..... 2835053

[51] Int. Cl.[2] ..... A63G 21/00

[52] U.S. Cl. ..... 272/56.5 R; 104/69; 238/281; 248/668; 193/2 R

[58] Field of Search ..... 272/56.5 R, 56.5 SS; 238/281, 282, 172, 215; 104/69, 118, 134; 248/668; 198/862; 193/2 R, 2 A, 15

[56] References Cited

U.S. PATENT DOCUMENTS

| | | | |
|---|---|---|---|
| 311,254 | 1/1885 | Nickerson | 238/281 |
| 802,394 | 10/1905 | Hill | 248/668 X |
| 1,214,245 | 1/1917 | Waples | 238/281 X |
| 1,357,180 | 10/1920 | Nelson | 238/281 |
| 2,270,909 | 1/1942 | Spizer | 272/56.5 R |
| 3,796,429 | 3/1974 | Johnston | 272/56.5 R |
| 3,970,300 | 7/1976 | Von Wendt et al. | 272/56.5 R |
| 4,109,904 | 8/1978 | Becker et al. | 272/56.5 R |

*Primary Examiner*—Richard C. Pinkham
*Assistant Examiner*—Arnold W. Kramer

[57] ABSTRACT

This invention relates to improvements in a slide support structure. The slide surface is comprised of a plurality of curved and straight segments, joined end to end to form the slide surface. The support includes a plurality of bearer support segments corresponding generally to the slide segments. The invention here relates to the spaced bearing connections between the two which allows for relative vertical and horizontal movements to align for and adjust for minor differences in the curvature of the related slide and support segments.

5 Claims, 2 Drawing Figures

ADJUSTABLE SUPPORT APPARATUS FOR SEGMENTS OF AN AMUSEMENT SLIDE

BACKGROUND AND STATEMENT OF THE INVENTION

This application is related to U.S. Application Ser. No. 930,565, filed Aug. 3, 1978, which in turn is a continuation-in-part of U.S. Ser. No. 774,033, filed Mar. 3, 1977, and U.S. Pat. No. 4,145,042, both of which applications are hereby incorporated by reference in their entirety.

The main applications relate to chutes for persons, consisting of at least one duct-shaped helical chute, carried by at least one support and formed from curved and optionally also partly from straight segments, the segments being supported via segment-support frames on bearer segments under the chute. In assembling the first chute, it may turn out that the curvature of the bearer segments does not always correspond accurately with the intended course of the chute and that the segments must be aligned in different places in different directions relative to the corresponding bearer segments. Originally, no provisions were made for such an alignment.

The object of the invention therefore is to provide a connection, adjustable in all directions, between the segment supporting frames and the bearer segments of the chute. This object is accomplished by the fact that the segment support frames are connected on the bearer segments by means of adapters which can be adjusted both vertically and horizontally. The adapters and/or parts connected to them are angle sections and have slotted holes for screws for the vertical and horizontal adjustment. The adapters are also inclined bracket plates, which can be displaced in relation to bearer plates which are also inclined. The height position of the supporting frame is altered by displacing one of the inclined plates relative to the other.

One of the inclined plates is supported on a spindle, which itself is mounted in a spindle guide. This spindle guide may be a part of the support frame. The bearer and support plates, preferably, are arranged on opposite sides of the support frame so as to slope in opposite directions. The supporting frame is lowered by unscrewing the movable plates and raised by screwing them together. The supporting frame is tilted by displacing one plate only. For this purpose, one of the plates has an arched effective area. The spindles are arranged on both sides of the supporting frame and aligned with one another, so that they form an axis, about which the supporting frame can be inclined in order to match the inclination of the chute segments.

In a further embodiment of the invention, the inclined plates are connected with one another by means of screws and, in each case, one of the plates has a slotted hole for the screw, so that the supporting frame may also be shifted in a direction parallel to the bearer segment.

In yet another embodiment of the invention, a pair of support plates may be joined together in bow-shaped fashion and welded to the bearer segment. Two welding sites only are then required on the bearer segment for one pair of support plates. One support plate is sufficiently high, that there is space between the lower side of the support plate and the bearer segment for loosening the screw.

An example of the operation of the invention is shown in the drawings and explained as follows.

DETAILED DESCRIPTION OF THE INVENTION

Figure 2:
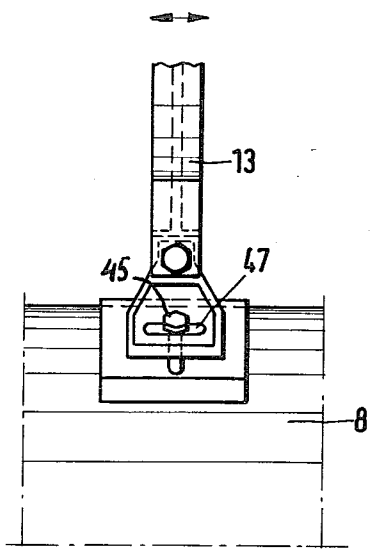
FIG. 2 is a side elevation of FIG. 1.

On the tubular bearer segment 8, a two-part support plate 42 is welded, which has inclined areas on both sides for bearer plates 41, which can be shifted by means of spindles 43. The spindles 43 are guided in spindle guides 44 of the supporting frame 13 and have a hexagonal head for turning the spindle, as well as a retaining ring 48 which, together with the nut at the outer spindle guide 44, fixes the position of the spindle in axial direction.

Figure 1:
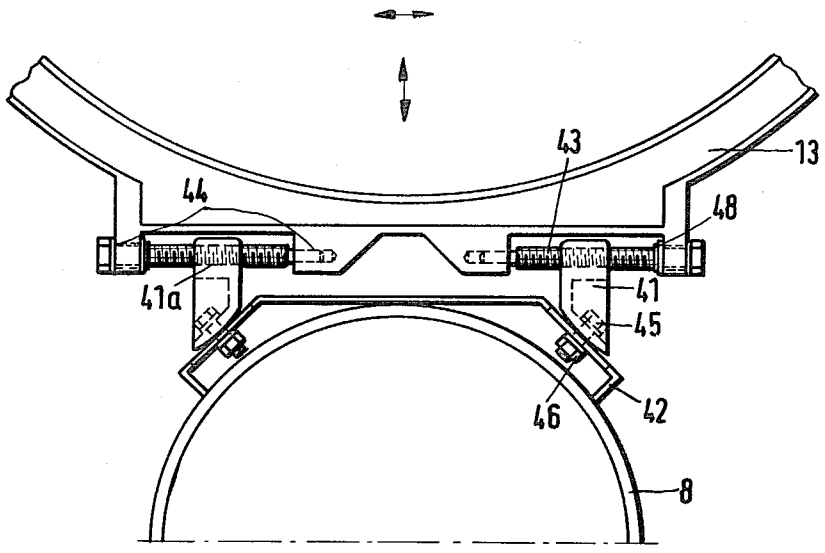
FIG. 1 shows a cross section of a bearer segment with the adjustable connection to the supporting frame.

The curvature of the bearer plate 41 on the support plate 42 can be recognized in FIG. 1. The curvature is such that, as the supporting frame 13 tilts relative to the bearer segment 8, no stress peaks develop. FIG. 1 also shows the free space below the support plate 42, in which the nut 46 of screw 45 can be turned.

In FIG. 2, a slotted hole 47 for screw 45 can be recognized. It is intended for the displacement of supporting frame 13 in the longitudinal direction of the bearer segment 8.

We claim:

1. An adjustment apparatus for adjusting the individual segments of an amusement slide relative to the corresponding bearer support segments thereof, comprising (a) a plurality of spaced apart supporting frames forming the support for said slide segments;

(b) a plurality of corresponding supporting bearer segments for said supporting frames; the improvement characterized by (c) a support plate mounted on each bearer segment;

(d) each said support plate including oppositely angled inclined surfaces between said supporting frame and said bearer segment;

(e) a bearer plate positioned at each inclined surface on each said support plate and engaging the said adjacent supporting frame;

(f) each said bearer plate having a cooperating inclined surface facing the corresponding inclined surface on said support plate;

(g) means for connecting each said bearer plate to said adjacent supporting frame and support plate; and (h) means in said connecting means allowing relative vertical and horizontal adjustment between said adjacent supporting frame and said bearer segment.

2. The apparatus of claim 1, further characterized by (a) said connecting means includes screws; and (b) said means in said connecting means allowing relative vertical and horizontal movement includes elongated slots.

3. The apparatus of claim 1, further characterized by said connecting means including (a) an adjusting spindle extending between the said adjacent supporting frame and each said bearer plate; and (b) spaced apart spindle guides on said adjacent supporting frame for receiving each said spindle.

4. The apparatus of claim 3, further characterized by (a) each oppositely positioned spindle for each pair of bearer plates which engage one support plate being coaxial.

5. The apparatus of claim 1, further characterized by (a) each said support plate having an arched effective surface.

* * * * *